United States Patent [19]

Kay et al.

[11] Patent Number: 4,944,076

[45] Date of Patent: Jul. 31, 1990

[54] CORRUGATED FIBERBOARD CASKET LIDS

[75] Inventors: William M. Kay, Boyertown, Pa.; Bruce E. Elder, Royal Oak, Mich.

[73] Assignees: Boyertown Casket Company, Boyertown, Pa.; Vandor Corporation, Rochester, Mich.

[21] Appl. No.: 54,129

[22] Filed: May 13, 1987

Related U.S. Application Data

[63] Continuation of Ser. No. 654,981, Sep. 27, 1984, abandoned.

[51] Int. Cl.[5] ..... A61G 17/00

[52] U.S. Cl. ..... 27/14; 27/2; 220/460

[58] Field of Search ..... 27/2, 3, 4, 14, 17, 27/18; 229/DIG. 2, DIG. 4, DIG. 5, 87 R; 220/460; 206/320

[56] References Cited

U.S. PATENT DOCUMENTS

| | | | |
|---|---|---|---|
| 212,655 | 2/1879 | Buck et al. | 27/7 |
| 520,366 | 5/1894 | Leaver | 229/DIG. 2 |
| 678,348 | 7/1901 | Nichols | 27/3 |
| 1,128,865 | 2/1915 | Freeman | 27/35 |
| 1,362,282 | 12/1920 | Beadle | 229/DIG. 5 |
| 2,111,337 | 3/1938 | Sherman | 27/3 |
| 2,338,035 | 12/1943 | Gerold | 27/14 |
| 2,945,281 | 7/1960 | Wilkirson | 27/17 |
| 3,135,452 | 6/1984 | Broudage | 220/460 X |
| 3,490,114 | 1/1970 | Connelly et al. | 27/2 |
| 3,734,389 | 5/1973 | Brown | 206/320 X |
| 4,063,337 | 12/1977 | Havey, III | 27/2 |
| 4,123,831 | 11/1978 | Covington | 27/2 |
| 4,151,630 | 5/1979 | Havey | 27/2 |
| 4,156,956 | 6/1979 | Partridge et al. | 27/4 |
| 4,170,054 | 10/1979 | Ruffner et al. | 27/4 |
| 4,209,880 | 7/1980 | Lindholm | 27/2 |
| 4,390,154 | 6/1983 | Ostler et al. | 229/DIG. 2 X |
| 4,730,370 | 3/1988 | Elder | 27/4 |
| 4,773,134 | 9/1988 | Kay | 27/2 X |

FOREIGN PATENT DOCUMENTS

| | | | |
|---|---|---|---|
| 2402470 | 7/1974 | Fed. Rep. of Germany | 27/4 |
| 2608058 | 9/1977 | Fed. Rep. of Germany | 27/2 |
| 3234715 | 7/1983 | Fed. Rep. of Germany | 27/4 |
| 1535188 | 12/1978 | United Kingdom | 27/2 |

*Primary Examiner*—Robert A. Hafer
*Assistant Examiner*—Sam Rimell
*Attorney, Agent, or Firm*—John T. Synnestvedt

[57] ABSTRACT

A lid for the shell or base of a casket is disclosed, the lid being formed of corrugated fiberboard. Two components or sheets of the corrugated fiberboard are employed in the construction of the lid, a first component being extended substantially throughout the width of the lid and having the corrugations extended in a direction transversely of the lid, and the other component being adhesively secured to the first component and having its corrugations extended longitudinally of the lid.

The lid is also provided with braces or reinforcing components in the form of transverse bridges applied to the underside of the assembled sheet components, the bridges being formed of corrugated fiberboard, having the corrugations thereof extended in the vertical direction.

4 Claims, 3 Drawing Sheets

FIG. 6
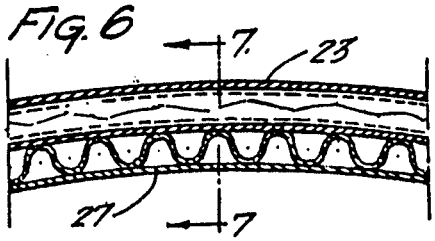
FIG. 7.
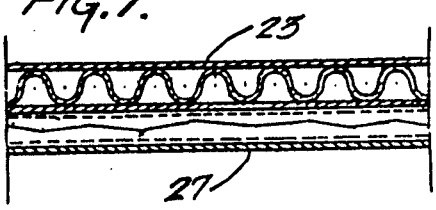
FIG. 8.
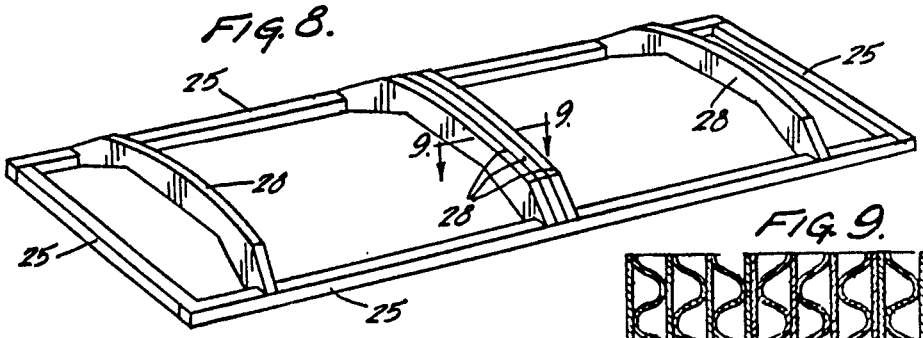
FIG. 9.
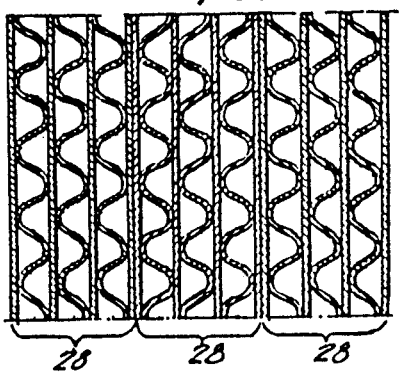
FIG. 10.
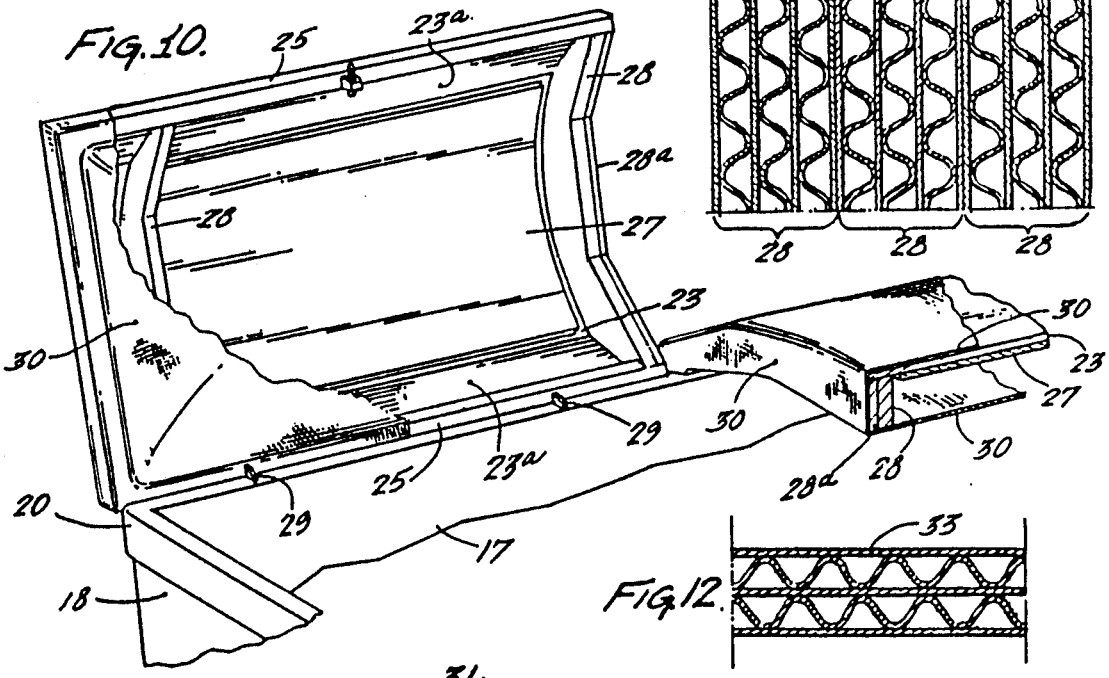
FIG. 12.
FIG. 11.
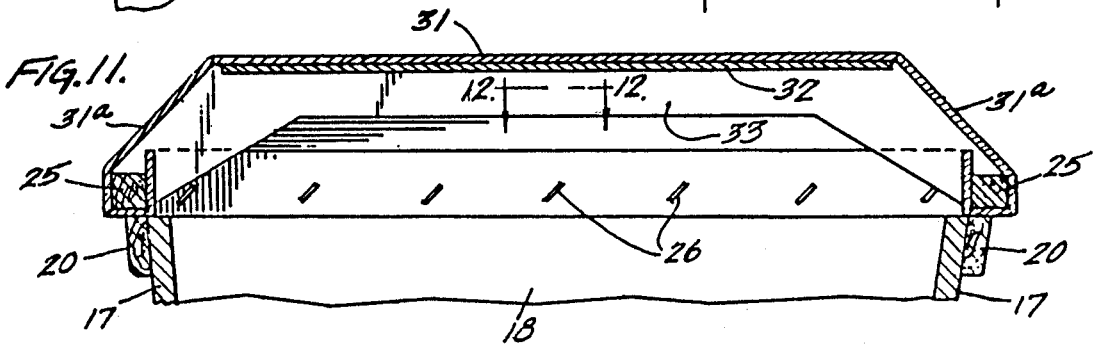

CORRUGATED FIBERBOARD CASKET LIDS

This is a continuation of co-pending application Ser. No. 64,981 filed on Sept. 27, 1984 now abandoned.

BACKGROUND AND STATEMENT OF OBJECTS

This application relates to an improved form of lid or cover particularly adapted for use in the fabrication of coffins or caskets formed of corrugated fiberboard.

It is an object of the invention to provide a lid having substantially improved strength characteristics in various planes, notwithstanding the fabrication of the lid from corrugated fiberboard.

It is a further object of the invention to provide a casket lid construction which may be extended throughout the entire length of the casket, or which may alternatively be cut in the mid-region in order to form a lid comprised of two separately moveable pieces.

Still further, it is another objective of the invention to provide a form of construction and reinforcement which is readily adaptable for use in alternative forms of the lid having different degrees of domed configuration in the central region, or alternatively being flat in the central region.

BRIEF DESCRIPTION OF THE DRAWINGS

How the foregoing objectives and advantages are attained will appear more fully from the following description referring to the accompanying drawings. In the drawings, three embodiments are illustrated, the first embodiment comprising FIGS. 1 to 10, inclusive, the second embodiment comprising FIGS. 11 and 12, and the third embodiment comprising FIGS. 13 to 16, inclusive.

FIRST EMBODIMENT

Figure 2:
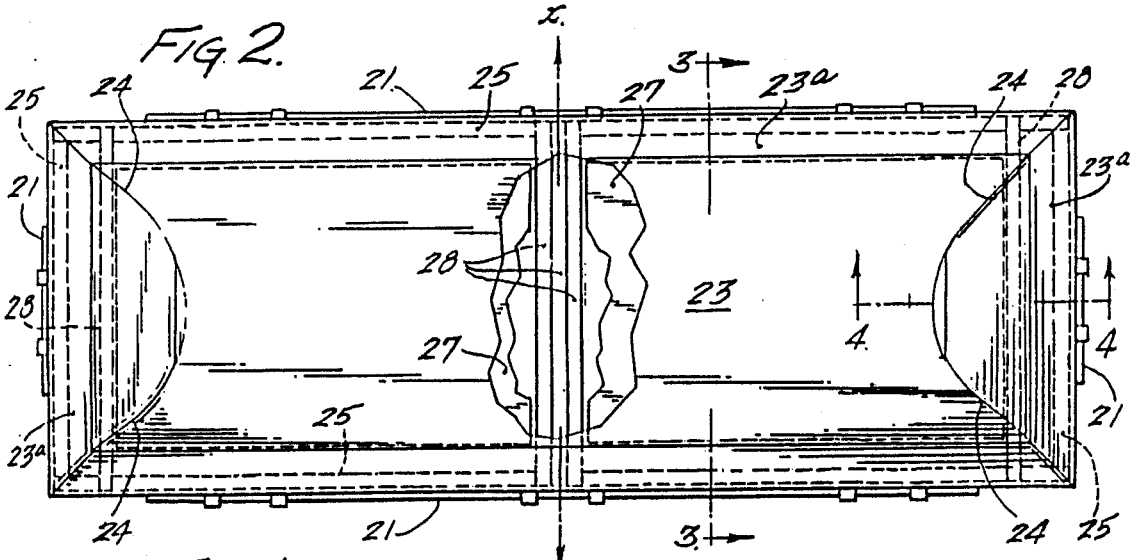
Figure 1:
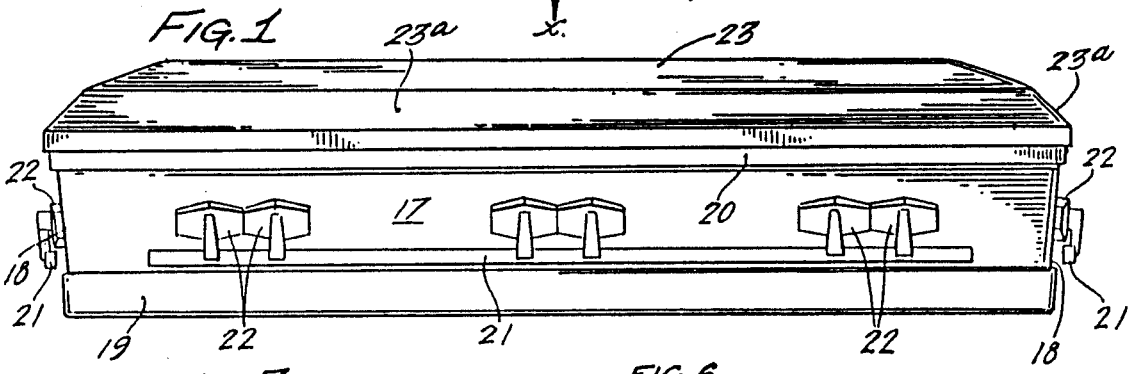
Figure 3:
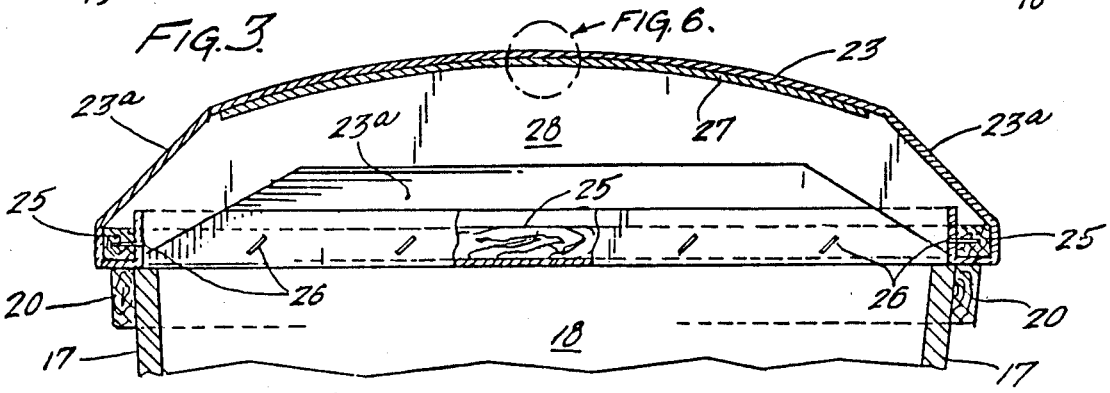
Figure 5:
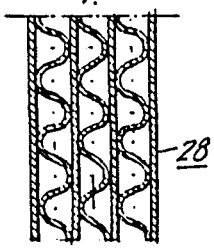
Figure 4:
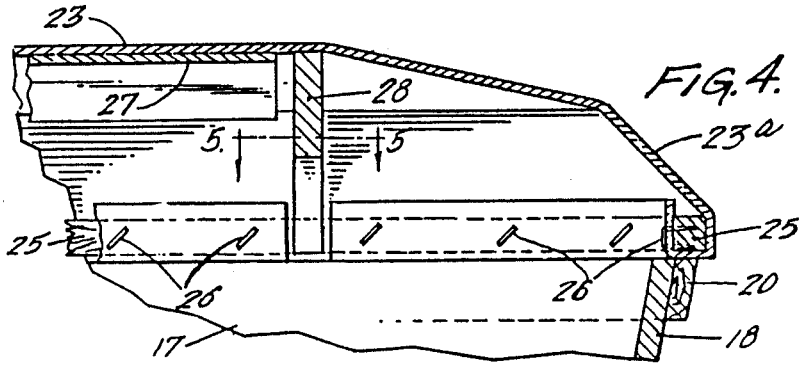

FIG. 1 is a side elevational view of a casket with a domed lid applied thereto, the lid being constructed in accordance with the present invention;

FIG. 2 is a plan view of the assembly shown in FIG. 1, with a portion of the central region of the lid broken out in order to illustrate parts lying within;

FIG. 3 is an enlarged fragmentary transverse sectional view taken as indicated by the section line 3–3 on FIG. 2;

FIG. 4 is a fragmentary enlarged sectional view taken as indicated by the section line 4—4 on FIG. 2;

FIG. 5 is a further enlarged view of a detail taken as indicated by the line 5—5 on FIG. 4;

FIG. 6 is an enlarged fragmentary detailed view taken as indicated by the circle marked FIG. 6 applied to FIG. 3;

FIG. 7 is a fragmentary sectional view taken as indicated by the section line 7—7 on FIG. 6;

FIG. 8 is a perspective view of certain parts of the lid of the first embodiment;

FIG. 9 is an enlarged fragmentary sectional view taken as indicated by the section line 9—9 on FIG. 8; and FIG. 10 is a fragmentary perspective view of the lid of the first embodiment after having been subdivided in the central region in order to form a lid of two parts which are separately openable.

Second Embodiment

FIG. 11 is a view similar to FIG. 3 but illustrating the configuration of the second embodiment; and FIG. 12 is a fragmentary sectional view taken as indicated by the section line 12—12 on FIG. 11.

Third Embodiment

Figure 13:
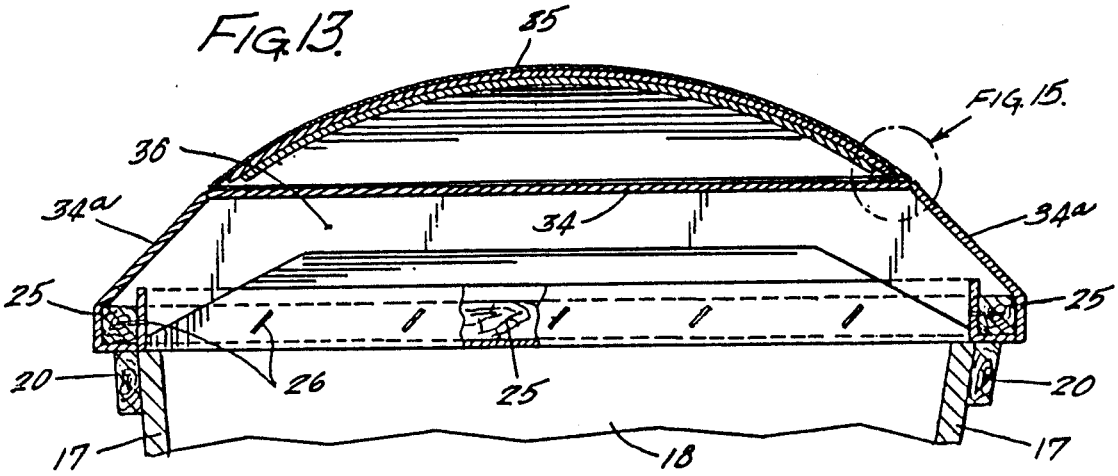
Figure 14:
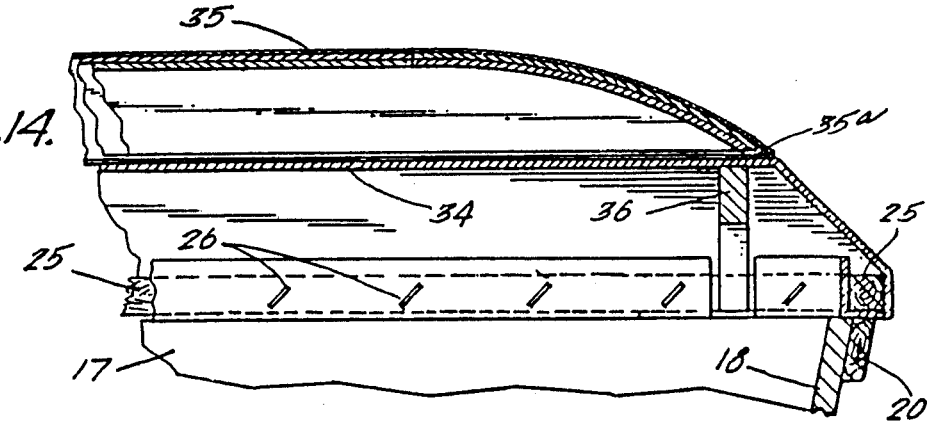
Figure 16:
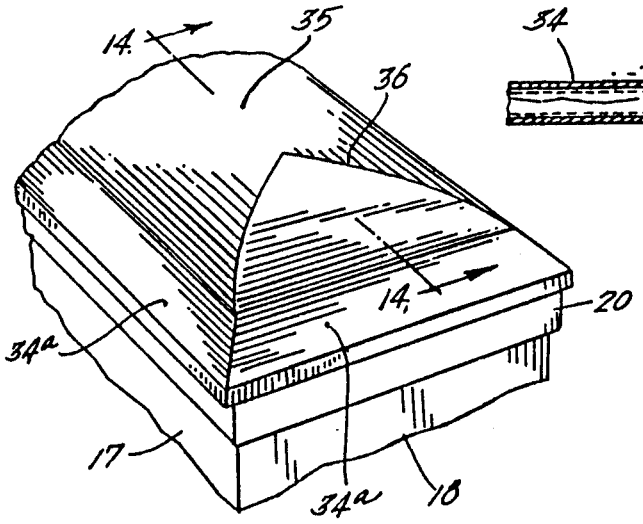
Figure 15:
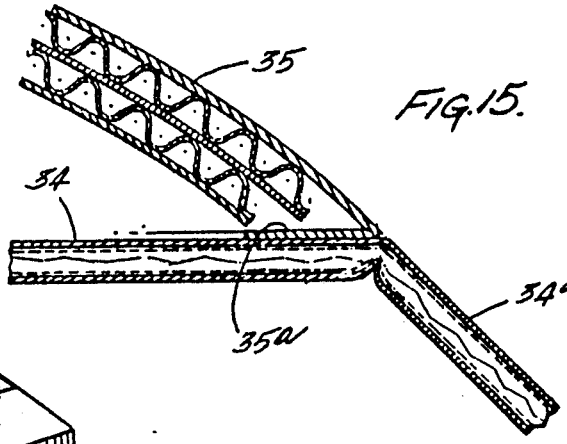

FIG. 13 is a view similar to FIGS. 6 and 11 but illustrating the third embodiment;

FIG. 14 is a fragmentary sectional view taken as indicated by the section line 14—14 on FIG. 16;

FIG. 15 is an enlarged fragmentary sectional view taken as indicated by the circle marked FIG. 15 on FIG. 13; and FIG. 16 is a fragmentary perspective view of an end portion of the casket lid of the third embodiment.

DETAILED DESCRIPTION OF THE DRAWINGS:

In considering various of the figures of the drawings, it should be noted that the corrugations of the corrugated fiberboard pieces employed in the fabrication of the various forms of casket lid disclosed are not illustrated in various of the sectional views, such as FIGS. 3, 4, 10, 11, 13 and 14. However, as to each form, enlarged fragmentary sectional views, such as FIGS. 5, 6, 7, 9, 12 and 15, are included in order to illustrate the construction of the fiberboard pieces employed and the orientation of the corrugations of each piece employed.

As above indicated, the present invention is concerned with the construction of the lid of the casket, and the various forms of lid disclosed may be employed with a shell or base of caskets of a variety of forms, it being contemplated that the corrugated fiberboard lids of the present invention will normally be employed in association with a shell or base also formed of corrugated fiberboard. Such a shell or base is shown in the figures illustrating the first embodiment. Thus, in FIGS. 1, 2, 3, 4 and 10, the casket shell is shown as having inclined side walls 17 and inclined end walls 18. In a typical embodiment of the shell, framing elements may be provided as indicated at 19 on the lower edges of the shell and may also be provided as indicated at 20 around the upper edges of the shell. The side and end walls 17 and 18 are desirably formed of corrugated fiberboard in a manner which need not be considered herein, and the framing elements 19 and 20 may be formed of wood.

The shell of the casket is also desirably provided with handgrip rails such as indicated at 21 secured to the walls of the shell by appropriate brackets 22 in a manner which need not be considered herein.

Turning now to the embodiment of the lid as shown in FIGS. 1 to 10, it will be seen that the lid disclosed in those figures includes a sheet or component extended substantially throughout the area of the lid, this sheet having a central upwardly domed portion 23 and being formed of corrugated fiberboard, for instance, of the type illustrated in FIGS. 6 and 7, having upper and lower sheets with an intervening corrugated layer. Such a sheet is commonly referred to as single-wall fiberboard. As will be seen from FIGS. 6 and 7, this sheet or layer 23 is positioned so that the corrugations thereof extend transversely of the lid.

The sheet 23, in addition to being domed in the central region, also has bevel edge portions indicated in various of the figures at **23*a*** which are arranged not only along the side edges of the lid but also at the ends thereof.

In each of the four corners of this top sheet 23 of the lid, cuts are made as indicated at 24 in FIG. 2, and tapered portions of the blank from of which the lid is fabricated are cut out at the corners so that when the side and end portions of the lid are flexed to the curvature and angular configuration indicated in FIGS. 3 and 4, the tapered cut-out regions will be closed.

The specific configuration of the lid in the end regions, and particularly in the regions where the end surfaces join the side surfaces, may vary somewhat, but it is contemplated according to the present invention that at least the major portion of the lid be formed by a principal lid component extended throughout the width of the lid and throughout at least most of the length of the lid and having the corrugations thereof extended in a direction transversely of the lid throughout not only the central domed region but also throughout the bevelled side edge portions thereof.

As seen particularly in FIGS. 3 and 4, the marginal edge portions of this principal lid component identified by the numeral 23 are folded to engage marginal edge framing elements 25 desirably formed of wood, the corrugated sheet material being secured to the edge framing 25 as by staples such as indicated at 26 in FIGS. 3 and 4.

The lid further includes another panel or layer connected with the layer 23 at least in the central region thereof. In the first embodiment (see particularly FIGS. 3, 4, 6 and 7), this additional layer is indicated at 27. This component preferably comprises what is known in the art as single face corrugated fiberboard, being formed of only a single plain layer and a single corrugated piece adhesively bonded to each other. The corrugated layer of this piece is desirably adhesively bonded to one of the surface layers of the single wall sheet 23 described above. This relationship is shown in FIGS. 6 and 7; and from FIGS. 6 and 7, it will further be noted that the corrugations of the single face piece 27 and the corrugations of the single wall piece 23 extend in different directions. Preferably, as shown, the corrugations of the single wall 23 extend transversely of the lid, and the corrugations of the single face 27 extend longitudinally of the lid. This relationship is of importance in contributing rigidity and strength to the lid structure. The inner single face reinforcement layer desirably is of width approximating the width of the central or domed portion of the layer 23, but the reinforcing layer is not needed at the bevel edge regions **23*a***. In addition, such reinforcement need not be applied at the terminal end portions of the lid.

As seen particularly in FIGS. 2, 3, 4, 8 and 9, the lid of the first embodiment also incorporates braces in the form of transversely extended bridges, which are also formed of corrugated fiberboard. These bridges are identified in the drawings by the numeral 28, and as best seen in FIG. 8, there is a transverse bridge 28 located near each end of the lid; and in the central region of the lid, a plurality of such transverse bridges are arranged in juxtaposed position.

From FIGS. 5 and 9, it will be seen that the bridges are also formed of corrugated fiberboard components. In the embodiment of FIGS. 1 to 10, inclusive, the components employed for the bridges comprise triple-wall corrugated fiberboard elements. Thus, in FIG. 5, it will be seen that the component there shown comprises four plain sheets separated by but adhesively bonded to three individual corrugated layers.

In the central region where three bridges are included, as will be seen from FIG. 9, there are three side-by-side triple-wall corrugated components.

In the case of all of the bridges 28, either at the end or in the central region of the lid, the corrugations of the components used extend in a direction perpendicular to the lid, and this is preferred in order to maximize the bracing contributed by the bridges. It should also be noted that with the corrugations extended vertically in the bridges (and, thus, generally perpendicularly to the lid), and with the corrugations of the layers 23 and 27 extended respectively transversely of the lid and longitudinally of the lid, the combined effect of the three different components interconnected with the corrugations extended in three different directions maximizes the strength and thereby provides for high strength with a minimum of material.

As has been pointed out above, the lid provided by the present invention may, if desired, be cut in the mid-region in order to provide two lid panels. As shown in FIG. 10, this is desirably effected by cutting in the central region of the central one of the three transverse bridges 28 employed in the central region. Thus, as seen in FIG. 10, each portion of the lid includes one of the bridges 28 and a portion of the central bridge **28*a***.

Whether the lid is mounted on the casket as one piece or as two pieces, the lid is preferably mounted by means of hinges as diagrammatically indicated at 29 in FIG. 10.

After construction of the completed casket and lid, fabric covering may be applied, a portion of such a covering being indicated at 30 in FIG. 10.

The alternative embodiment shown in FIGS. 11 and 12 includes a main single-wall layer 31 extended substantially throughout the length and width of the lid, but in this instance, the central portion of the lid is not domed but is flat. However, bevel edges **31*a* are desirably provided not only on the longitudinal edges of the lid but also at the ends thereof. The inner panel 32, shown in FIG. 11, extends throughout the central region of the component 31. As in the embodiment of FIGS. 1 to 10, it is contemplated that the corrugations of the single-wall layer 31 be extended transversely of the lid, and the corrugations of the single-face layer 32** be extended longitudinally of the lid.

The lid of the embodiment shown in FIGS. 11 and 12 also includes transverse bridges 33 and, as seen in FIG. 12, these bridges are formed of double-wall corrugated fiberboard comprising three planar sheets and two corrugated layers. As in the first embodiment, the bridges are adhesively bonded to the lid. The corrugations of this component in FIG. 12 extend vertically, i.e., transversely to the general plane of the lid, thereby providing the interbracing effect above described in combination with the transverse and longitudinal corrugation extension provided in the components 31 and 32 of which the lid is formed.

Turning now to the third embodiment, as shown in FIGS. 13 to 16, it will be seen that the lid here shown includes as one component a single-wall layer 34 having bevel edge portions **34*a* along the side edges and also along the end edges thereof. This component is formed of single-wall corrugated fiberboard of the kind above described, with the corrugations extended transversely of the lid, as in component 23 of the first embodiment and component 31** of the second embodiment.

In the embodiment of FIGS. 13 to 16, the additional component incorporated in the lid with corrugations extending longitudinally of the lid comprises a layer 35 formed of corrugated and uncorrugated fiberboard sheets, as seen particularly in FIG. 15. It will be noted that the corrugations of this component extend lengthwise of the lid, i.e., in a direction perpendicular to the corrugations of the component 34. The component 35, as seen in FIGS. 13 and 14, is domed transversely and also has domed end portions in the end regions of the lid. Preferably, the end regions are formed from a blank of tapered plan form so as to fit into recessed cutouts at the ends of the components 35 and 34*a* along lines indicated at 36 in FIG. 16. The end portions, and the central part of the component 35, are also adhesively secured to each other. At the edges of the component 35 along the lines of junction with the component 34, the inner layers of the fiberboard component 35 employed may be cut back and the outer planar layer folded under as indicated at 35*a* in FIG. 15, in order to provide an appreciable surface area for adhesive bonding between the edges of the component 35 and the edges of the component 34.

As in the first and second embodiments, transverse reinforcement bridges 36 are also provided in the embodiment in FIGS. 13 to 16, and these bridges are preferably applied and adhesively bonded in the end regions of the lid and also in the central region. In the preferred construction, these bridges are desirably formed of triple-wall corrugated fiberboard in the manner indicated in FIG. 9. It is also contemplated that in the third embodiment, three triple-wall bridges will be employed in the central region in order to facilitate cutting of the lid into two halves wherever that is desired, while still retaining effective reinforcement for the two panels of the lid.

As in the first and second embodiments, in the embodiment of FIGS. 13 to 16, the corrugations of the bridges extend vertically and, thereby, in combination with the transverse and longitudinal extension of the corrugations in the layers 34 and 35, provide the desired three-way reinforcement achieved as a result of the three-way extension of corrugations in the three principal components of the lid. In all cases, all of these components are adhesively bonded to each other and the resultant structure has great strength when considered in relation to the quantity and weight of materials employed.

We claim:

1. A lid for closure of the base or shell of a casket, the principal closure area of the lid consisting of first and second laminated corrugated fiberboard layers, the first of said laminated fiberboard layers being formed as a unitary panel, extending substantially throughout the length and width of the lid from a flat sheet of single-wall fiberboard and comprising an elongated central area and bevelled edge portions at both the side and end edges of the lid, said unitary panel consisting of a single corrugated sheet with an uncorrugated sheet at each side of the corrugated sheet, the axes of the corrugations of said single corrugated sheet being extended transversely of the longitudinal axis of the lid, said unitary panel further having its central region progressively increased in height both laterally and longitudinally thereby providing a central domed area between the bevelled edges both laterally and longitudinally of the lid, frame structure connected with said unitary panel on the inner side thereof, the frame structure including a plurality of longitudinally spaced transversely extending bridges each having inclined portions engaged with the bevelled side edge portions of the lid and each further having an upwardly curved surface engaged with the central domed area of the lid, and the frame structure including marginal framing elements interconnected with the side and end edges of said unitary panel, the transversely extending bridges being formed of multiple wall corrugated fiberboard having a plurality of corrugated sheets each having planar sheets at each side of each corrugated sheet and with the axes of the corrugations vertically aligned relative to the inner surface of the lid and thus also substantially perpendicularly to the axes of the corrugations of said first fiberboard layer of the lid, and said second layer of the principal closure area of the lid being formed of separate partial panels each lying at the underside of the unitary panel of the first layer in an area thereof between spaced bridges of the framing structure, the side edges of said partial panels being terminated inboard of the bevelled side edges of the first layer, each of said partial panels consisting of a single corrugated sheet and a single uncorrugated sheet, and the corrugated sheet of each partial panel being adhesively bonded to the unitary panel of the first layer and with the axes of the corrugations extended longitudinally of the lid and transversely of the axes of the corrugations of said first layer.

2. A lid for closure of the base or shell of a casket, the principal closure area of the lid consisting of first and second laminated corrugated fiberboard layers, the first of said laminated fiberboard layers being formed as a unitary panel, extending substantially throughout the length and width of the lid from a flat sheet of single-wall fiberboard and comprising an elongated central area and bevelled edge portions at both the side and end edges of the lid, said unitary panel consisting of a single corrugated sheet with an uncorrugated sheet at each side of the corrugated sheet, the axes of the corrugations of said single corrugated sheet being extended transversely of the longitudinal axis of the lid, frame structure connected with said unitary panel on the inner side thereof, the frame structure including a plurality of longitudinally spaced transversely extending bridges each having inclined portions engaged with the bevelled side edge portions of the lid and each further having an upper edge engaged with the underside of the central portion of the first fiberboard layer, and the frame structure including marginal framing elements interconnected with the outer edges of said bevelled edge portions of said unitary panel, the transversely extending bridges being formed of multiple wall corrugated fiberboard having a plurality of corrugated sheets each having planar sheets at each side of each corrugated sheet and with the axes of the corrugations vertically aligned relative to the inner surface of the lid and thus also substantially perpendicularly to the axes of the corrugations of said first fiberboard layer of the lid, and said second layer of the principal closure area of the lid being formed of separate partial panels each being at the underside of the unitary panel of the first layer in an area thereof between spaced bridges of the frame structure, the side edges of said partial panels being terminated inboard of the bevelled side edges of the first layer, each of said partial panels consisting of a single corrugated sheet and a single uncorrugated sheet, and the corrugated sheet of each partial panel being adhesively bonded to the unitary panel of the first layer and with the axes of the corrugations extended longitudinally of the lid and transversely of the axes of the corrugations of said first layer.

3. A lid for closure of the base or shell of a casket, the principal closure area of the lid consisting of first and second laminated corrugated fiberboard layers, the first of said laminated fiberboard layers being formed as a unitary panel, extending substantially throughout the length and width of the lid from a sheet of single-wall fiberboard and comprising an elongated central area and bevelled edge portions at both the side and end edges of the lid, said unitary panel consisting of a single corrugated sheet with an uncorrugated sheet at each side of the corrugated sheet, the axes of the corrugations of said single corrugated sheet being extended transversely of the longitudinal axis of the lid, frame structure connected with said unitary panel on the inner side thereof, the frame structure including a plurality of longitudinally spaced transversely extending bridges each having inclined portions engaged with the bevelled side edge portions of the lid and each further having an upper edge engaged with the underside of the central portion of the first fiberboard layer, and the frame structure including marginal framing elements interconnected with the outer edges of said bevelled edge portions of said unitary panel, the transversely extending bridges being formed of multiple wall corrugated fiberboard having a plurality of corrugated sheets each having planar sheets at each side of each corrugated sheet and with the axes of the corrugations vertically aligned relative to the inner surface of the lid and thus also substantially perpendicularly to the axes of the corrugations of said first fiberboard layer of the lid, and said second layer of the principal closure area of the lid comprising a panel including at least one layer consisting of one corrugated sheet and one uncorrugated sheet, said second layer being adhesively bonded to the unitary panel of the first layer and with the axes of the corrugations extended longitudinally of the lid and transversely of the axes of the corrugations of said first layer.

4. A lid for closure of the base or shell of a casket, the principal closure area of the lid consisting of first and second laminated corrugated fiberboard layers, the first of said laminated fiberboard layers being formed as a unitary panel, extending substantially throughout the length and width of the lid from a sheet of single-wall fiberboard and comprising an elongated central area and bevelled edge portions at both the side and end edges of the lid, said unitary panel consisting of a single corrugated sheet with an uncorrugated sheet at each side of the corrugated sheet, the axes of the corrugations of said single corrugated sheet being extended transversely of the longitudinal axis of the lid, frame structure connected with said unitary panel on the inner side thereof, the frame structure including a plurality of longitudinally spaced transversely extending bridges each having inclined portions engaged with the bevelled side edge portions of the lid and each further having an upper edge engaged with the underside of the central portion of the first fiberboard layer, and the frame structure including marginal framing elements interconnected with the outer edges of said bevelled edge portions of said unitary panel, the transversely extending bridges being formed of multiple wall corrugated fiberboard having a plurality of corrugated sheets each having planar sheets at each side of each corrugated sheet and with the axes of the corrugations vertically aligned relative to the inner surface of the lid and thus also substantially perpendicularly to the axes of the corrugations of said first fiberboard layer of the lid, and said second layer of the principal closure area of the lid comprising a partial panel consisting of single-face corrugated fiberboard consisting of a single corrugated sheet and a single uncorrugated sheet with the corrugated sheet presented toward and adhesively secured to the underside of said first fiberboard layer and with the axes of the corrugations extended longitudinally of the lid and transversely of the axes of the corrugations of said first fiberboard layer, the side edges of said partial panel being terminated inboard of the bevelled side edge portions of the first layer.

* * * * *